US010640999B2

(12) United States Patent
Cody

(10) Patent No.: US 10,640,999 B2
(45) Date of Patent: May 5, 2020

(54) EARTHQUAKE DAMPENING PLATFORM FOR A GROUND LEVEL STORAGE VESSEL

(71) Applicant: Steve Cody, Coalgate, OK (US)

(72) Inventor: Steve Cody, Coalgate, OK (US)

( * ) Notice: Subject to any disclaimer, the term of this patent is extended or adjusted under 35 U.S.C. 154(b) by 0 days.

(21) Appl. No.: 15/731,740

(22) Filed: Jul. 26, 2017

(65) Prior Publication Data

US 2019/0264461 A1 Aug. 29, 2019

(51) Int. Cl.

| | |
|---|---|
| ***E04H 9/00*** | (2006.01) |
| ***E04H 9/02*** | (2006.01) |
| ***E04H 7/02*** | (2006.01) |
| ***E02D 27/34*** | (2006.01) |

(52) U.S. Cl.

CPC ..... *E04H 7/02* (2013.01); *E02D 27/34* (2013.01); *E04H 9/02* (2013.01); *E04H 9/027* (2013.01); *E04H 9/028* (2013.01)

(58) Field of Classification Search

CPC E04H 9/02; E04H 9/027; E04H 9/028; E04H 9/029; E04H 2009/026; E04H 9/00

See application file for complete search history.

(56) References Cited

U.S. PATENT DOCUMENTS

| | | | | | |
|---|---|---|---|---|---|
| 1,908,684 | A | | 5/1933 | Buchanan | |
| 2,563,118 | A | * | 8/1951 | Jackson | F17C 3/022 114/74 A |
| 3,025,993 | A | * | 3/1962 | Horton | E04H 7/18 220/560.05 |
| 3,139,286 | A | | 6/1964 | Johnson | |
| 3,310,345 | A | | 3/1967 | Rowden | |
| 3,540,385 | A | * | 11/1970 | Hobart | B65D 19/0095 108/52.1 |
| 3,612,333 | A | * | 10/1971 | Cowles | B65D 90/08 114/74 A |
| 3,687,149 | A | * | 8/1972 | Wissmiller | F16K 17/383 137/72 |
| 3,894,505 | A | * | 7/1975 | Murphy | B63B 25/12 114/74 A |
| 3,927,497 | A | * | 12/1975 | Yoshinaga | E02D 27/38 52/169.1 |
| 3,990,600 | A | * | 11/1976 | Rossitto | B65D 88/08 220/565 |
| 4,041,722 | A | * | 8/1977 | Terlesky | F17C 3/022 165/45 |
| 4,249,352 | A | | 2/1981 | Marchaj | |
| 4,258,953 | A | | 3/1981 | Johnson | |
| 4,267,676 | A | | 5/1981 | Marchaj | |
| 4,321,776 | A | * | 3/1982 | Delight | C30B 1/023 52/167.1 |
| 4,348,047 | A | | 9/1982 | Harshman | |
| 4,871,081 | A | * | 10/1989 | Ershig | B65D 90/24 116/112 |
| 5,782,524 | A | | 7/1998 | Heider | |
| 5,970,666 | A | | 10/1999 | Kurabayashi | |

(Continued)

*Primary Examiner* — Phi Dieu Tran A

(74) *Attorney, Agent, or Firm* — Randal Homburg

(57) ABSTRACT

A ground level platform upon which is secured a liquid storage tank, the platform providing a dampening frame, an upper plate, a lower plate and a plurality of ground cleats attaching to aligned lower tank brackets, each paired and aligned ground cleat and lower tank bracket attached by a torsion tightened threaded bolt, the ground level platform absorbing and deterring vibration from earthquakes from damaging the secured liquid storage tank.

5 Claims, 5 Drawing Sheets

(56) References Cited

U.S. PATENT DOCUMENTS

| | | | | |
|---|---|---|---|---|
| 5,979,684 | A * | 11/1999 | Ohnishi | B62D 29/045 220/1.5 |
| 6,971,495 | B2 | 12/2005 | Hedrick | |
| 7,314,058 | B2 * | 1/2008 | Saito | B65D 88/08 137/312 |
| 8,603,375 | B2 * | 12/2013 | Simmons | F17C 3/022 220/560.04 |
| 9,506,265 | B1 | 11/2016 | Lee | |
| 2011/0023387 | A1 * | 2/2011 | Sweeney | E04H 9/021 52/167.4 |
| 2013/0152491 | A1 | 6/2013 | Jin | |

* cited by examiner

EARTHQUAKE DAMPENING PLATFORM FOR A GROUND LEVEL STORAGE VESSEL

CROSS REFERENCE TO RELATED APPLICATIONS

None.

I. BACKGROUND OF THE INVENTION

1. Field of Invention

A ground level platform upon which is secured a liquid storage tank, the platform providing a dampening frame, an upper plate, a lower plate and a plurality of ground cleats attaching to aligned lower tank brackets, each paired and aligned ground cleat and lower tank bracket attached by a torsion tightened threaded bolt, the ground level platform absorbing and deterring vibration from earthquakes from affected the secured liquid storage tank.

2. Description of Prior Art

A preliminary review of prior art patents was conducted by the applicant which reveal prior art patents in a similar field or having similar use. However, the prior art inventions do not disclose the same or similar elements as the present vibration dampening platform, nor do they present the material components in a manner contemplated or anticipated in the prior art.

In U.S. Pat. No. 5,607,133 to Markham, a hot water tank strap and a cable tie system engage the lower part of a circular tank. In U.S. Pat. No. 4,249,352 to Marchaj, a cable tie down system uses a vertical cable tie down integrating with a concrete base pad for the tank to rest upon. In U.S. Pat. No. 4,267,676 to Marchaj, a tank construction involving a tapering wall thickness and banding by a plurality of reinforcing means. A fourth patent, U.S. Pat. No. 5,568,705 to Bellavista has a shaped disk with a polymer filling as a pad for placement under a structure.

Several prior art patents deal with earthquake suppression for buildings using various support structures to provide stability to the building components resting upon them. These include U.S. Pat. No. 9,506,265 to Lee, U.S. Pat. No. 5,970,666 to Kurabayashi and U.S. Patent App. No. 2013/0152491 to Jin. These prior art platforms are commonly installed underground and support pillars or beams upon which the building is erected.

The present platform for ground level storage vessels is placed upon a level ground surface which is commonly used for storage vessels to be placed upon. These vessel pad sites are often prepared by leveling the location, enhancing the ground surface with supporting auxiliary soils, surfacing materials, gravel or crushed stone. Additionally, they may be lined with a liquid impermeable membrane and surrounded by a containment bank or raised perimeter barrier. This is especially true in the oil filed where government regulations require environmental containment measures. It is also true where vessels contain hazardous liquids and chemicals. The present platform may be placed upon the level ground surface prior to installation of the vessels or may be installed under existing vessels with the vessels being reinstalled upon them subsequent to placement.

II. SUMMARY OF THE INVENTION

Liquid tanks in earthquake prone zones are subject to vibration forces which can interrupt of break the integrity of the tanks or shift the tanks from a stabilized prepared surface to an unstable ground surface in a matter of seconds. As seen in the prior art, this problem with earthquakes has been identified and attempts have been made to resolve or mitigate the damages caused by this natural phenomenon. Other technologies, including stabilization and dampening of buildings, towers and various other structures have also dealt with attempting to dampen the ground vibration forces upon structures.

The present platform is intended to absorb as much earthquake vibration as possible to prevent the vibration forces from reaching the liquid tank. The platform frame is structurally suited for placement of an upper surface panel and a lower surface panel, the lower surface panel engaging the ground and the upper surface panel providing the base upon which the liquid tank is secured. The upper surface panel also has a plurality of perimeter floor cleats attaching to lower tank brackets by a torsion tensioning means. Using these combined elements, the present ground dampening platform provides proven and unexpected success in dampening the ground forces which would be presented upon the liquid tank without the present platform.

III. DESCRIPTION OF THE DRAWINGS

The following drawings are submitted with this utility patent application.

Figure 5:
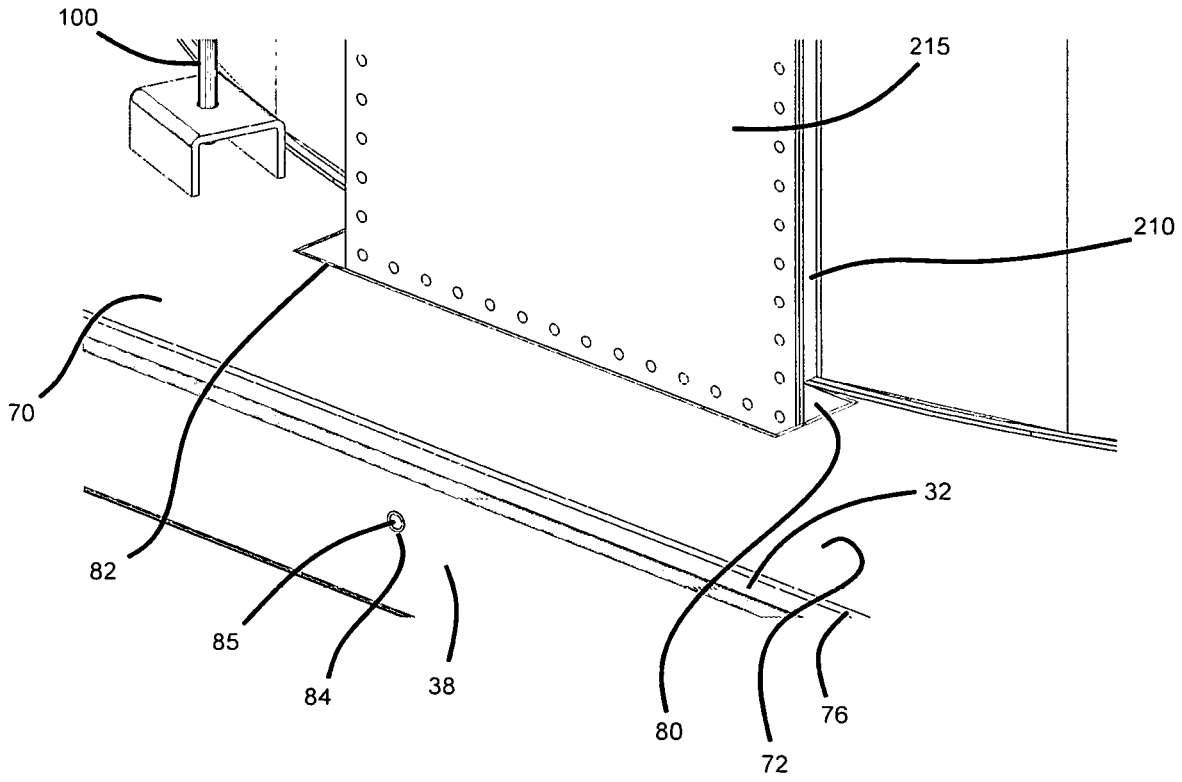

FIG. 5 is an isolation view of the manway trough and manway insert channel underneath the manway and the manway access panel provided in the vessel being attached to the upper surface of the united platform sections providing an auxiliary drain hole and drain tube incorporated into the manway trough leading to an outer margin of the platform section to drain any accumulation of water which would be presented by the environment or the contents of the vessel when the manway is opened to service the vessel.

IV. DESCRIPTION OF THE PREFERRED EMBODIMENT

An earthquake dampening platform 10 upon which a liquid vessel 200 is secured, the platform 10, shown in FIGS. 1-5 of the drawings, comprising at least one hollow inner frame assembly 30, a peripherally connected upper surface plate 70, a peripherally connected lower surface plate 60, a plurality of anchor cleat assemblies 100 to attach a lower perimeter portion 205 of the vessel 200 to said upper plate 70, and a manway trough 80 with a drainage system positioned below a manway 210 and manway access panel 215 of the vessel 200 which is secured in manner providing the manway access panel 215 positioned above the manway trough 80 for removal of the manway access panel 215 incorporated into the attached vessel 200. For purposes of the specification, the manway 210 and manway access panel 215 are located within the subject vessels 200 mounted to the earthquake dampening platform 10 as required by OSHA regulations, to access the interior of the vessel 200 for cleaning and safety purposes.

A preferred embodiment of the platform 10 is provided in two symmetrical sections, 20*a* and 20*b*, although the platform 10 may be provided as a singular section or connected sections in excess of two, depending upon the size of the vessel, not shown in the drawings. For large capacity vessels, defined herein as having a diameter in excess of 10 feet, the multiple section platforms are preferred. For smaller capacity vessels, defined herein as having a diameter of less than 10 feet, a singular section platform may suffice.

Figure 1:
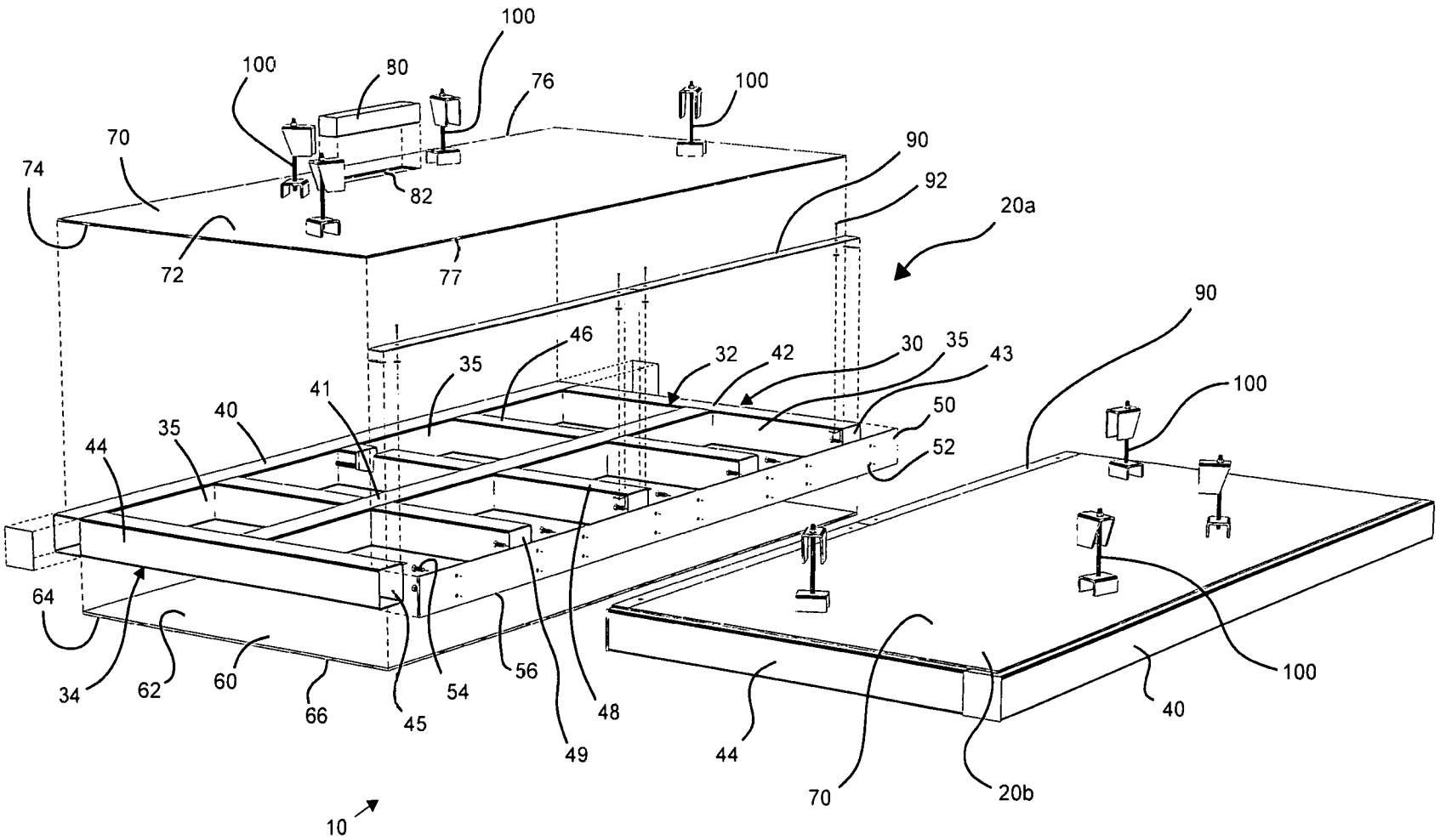
FIG. 1 is a side view of a liquid vessel secured to the earthquake dampening platform.
Figure 2:
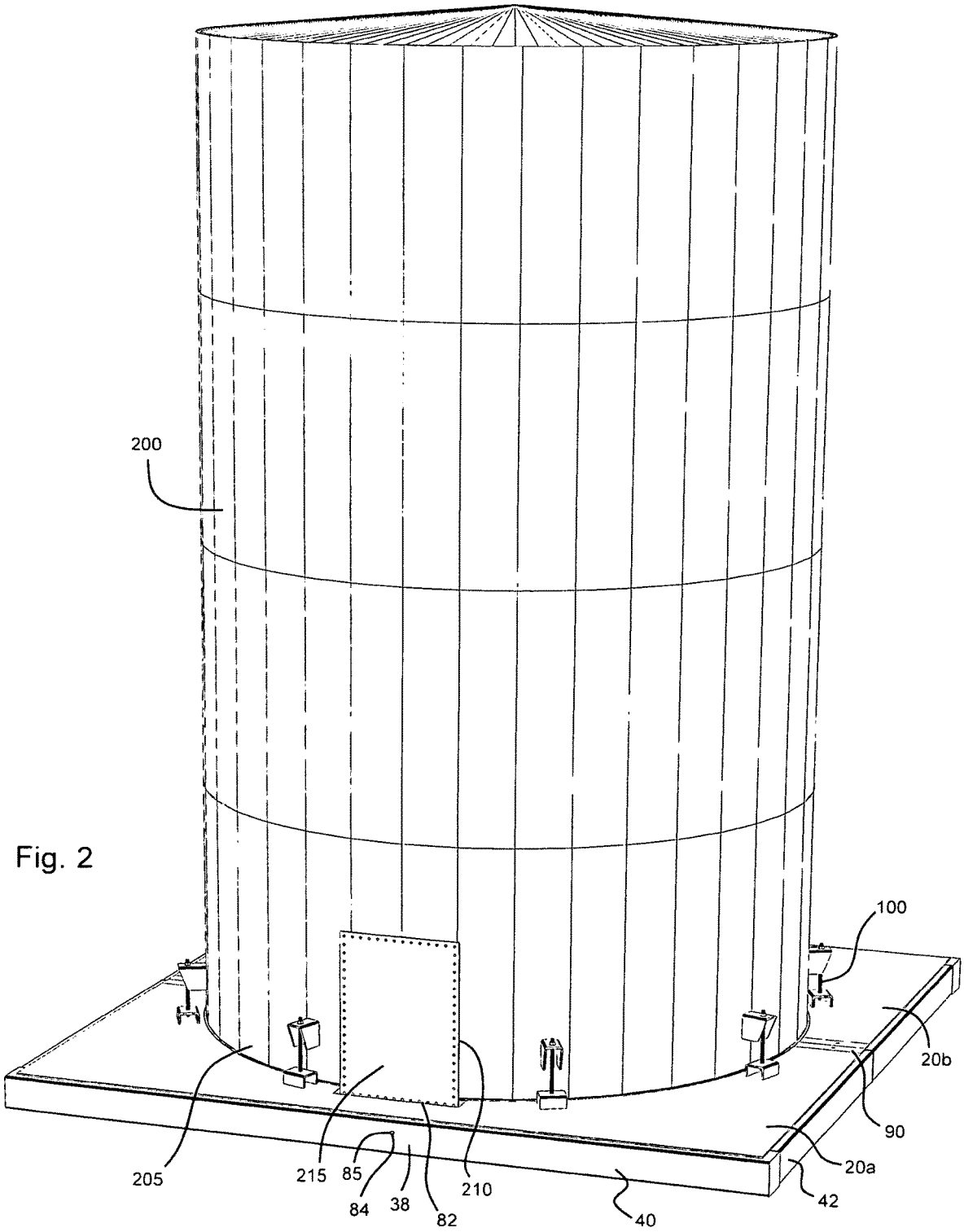
FIG. 2 is an exploded view of the earthquake dampening platform.
Figure 3:
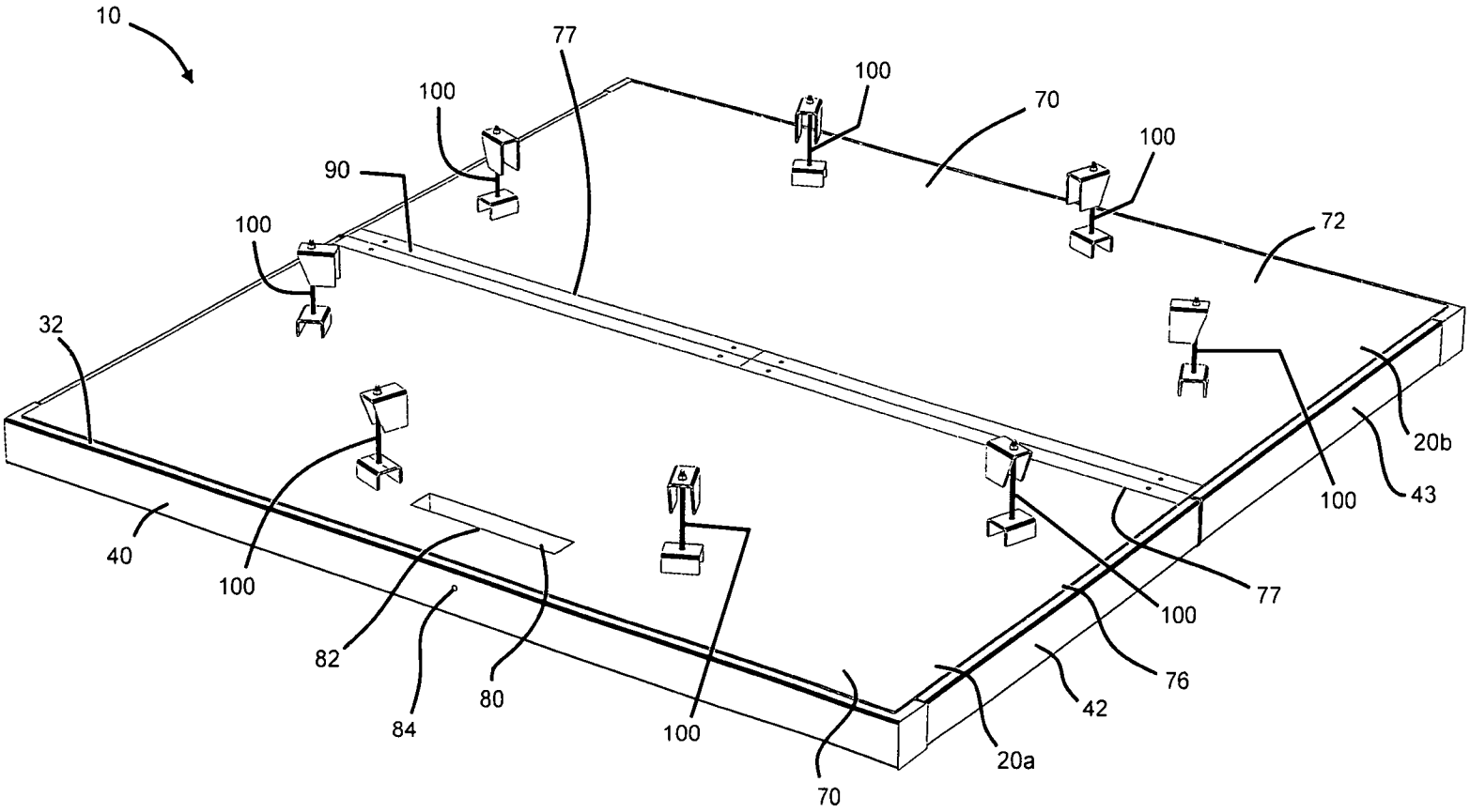
FIG. 3 is an upper perspective view of the assembled earthquake dampening platform.

The platform 10, as shown in FIGS. 1-5, depicts a two symmetrical sections 20*a*, 20*b*, each of the two symmetrical sections of the platform further comprising the hollow segmented inner frame assembly 30 defining an upper surface 32 and a lower surface 34, and composed of an outer tubular frame member 40, a first end tubular frame member 42, a second end tubular frame member 44, a central tubular frame member 41 secured midway between the first and second end tubular frame members 42, 44, and parallel to the outer tubular frame member 40, a plurality of parallel inner spanning tubular frame members 46 secured between the outer tubular frame member 40 and the central tubular frame member 41, with parallel inner extending tubular frame members 48 extending from the central tubular frame member 41, parallel to the first and second end tubular frame members 42, 44, each inner extending tubular frame member 48 and each said first and second end tubular frame members 42, 44, terminating respectively into an exposed plate connecting end 43, 45 and 49, in a planar alignment. A plurality of sectional voids 35 are formed within the inner frame assembly 30 in a checkerboard pattern, as shown in FIG. 1. While each above tubular frame member has been shown in a preferred embodiment as square tubing in FIGS. 1-4, it is contemplated that the tubular frame members can include a rounded tubular shape, a rectangular tubular shape, or any other shape provided that the upper and lower plates 60, 70, can be attached to the inner frame assembly 30 as further defined.

In the preferred embodiment, a common inner attachment plate 50 is welded to the aligned exposed plate connecting ends 43, 45 and 49, of each inner extending tubular frame member 48 and each said first and second end tubular frame members 42, 44. The common inner attachment plate 50 is provided with a plurality of connector bores 52 each connector bore accepting a threaded bolt 54 used to attach facing common inner attachment plates from one symmetrical section 20*a* to another reversed symmetrical section 20*b*, each threaded bolt 54 providing a threaded nut to uniformly secure each threaded bolt 54 holding the symmetrical sections 20*a*, 20*b*, together to form a common platform 10 for the vessel 200.

Each lower surface plate 60 defines an upper surface 62, a lower surface 64 and an outer peripheral margin 66. Attachment of each lower surface plate 60 would include the upper surface 62 of the lower surface plate 60 welded or otherwise attached to the lower surface 32 of the hollow segmented inner frame assembly 30 on all four peripheral margins 66 along the outer tubular frame member 40, the first and second end tubular frame members 42, 44, and a lower margin 56 of the common inner attachment plate 50, with no gaps in the welding line to eliminate intrusion of water between the lower surface plate 60 and the lower surface 34 of the inner frame assembly 30. The attachment of the lower surface plate 60 to the hollow segmented inner frame assembly 30 is essentially only at the outer peripheral edge 66, and not at any other location. This provides one aspect of the earthquake dampening platform 10 to provide a vibration dampening effect between the lower surface plate 60 and the hollow segmented inner frame assembly 30.

Each upper surface plate 70 defines and upper surface 72, a lower surface 74, an manway trough 80, a manway insert channel 82, an outer peripheral margin 76 and an inner peripheral edge 77. Attachment of each upper surface plate 70 would include the lower surface 74 of the upper surface plate 70 welded or otherwise attached to the upper surface 32 of the hollow segmented inner frame assembly 30 on three peripheral margins 76 along the outer tubular frame member 40 and the first and second end tubular frame members 42, 44. It is required that the inner peripheral edge 78 not extend all the way to the common inner attachment plate 50, providing a connecting access gap between the inner peripheral edge 77 of the upper surface plate 70 and the common inner attachment plate 50. This gap provides access for the insertion and tightening of the threaded bolts 54 and nuts through the plurality of connector bores 52 within the respective common inner attachment plates 50 of the two symmetrical sections 20*a*, 20*b*, of the platform 10 while attaching the facing symmetrical sections 20*a*, 20*b*, forming the united earthquake dampening platform 10 upon which a liquid vessel 200 is secured in the two symmetrical section embodiment. The inner peripheral edge 77 is welded to the intersecting portions of the inner extending tubular frame members 48 extending from the central tubular frame member 41 and those portions above each first and second end tubular frame members 42, 44. The attachment of the upper surface plate 70 to the hollow segmented inner frame assembly 30 is only at the outer peripheral edge 76 and at the various locations of the inner peripheral edge 77, and not at any other location. This provides a second essential aspect of the earthquake dampening platform 10 to provide vibration dampening between the lower surface 74 of the upper surface plate 70 and the hollow segmented inner frame assembly 30.

The width of each manway trough 80 and manway insert channel 82 is determined by the width of the manway 210 and the manway access panel 215 provided in the vessel 200 secured upon the upper surfaces 72 of the adjacently joined upper surface plates 70, as shown in FIG. 5 of the drawings. It would be preferred that an auxiliary drain hole 84 and drain tube 85 are incorporated into the manway trough 80 leading to an outer margin 38 of the inner frame assembly 30 to drain any accumulation of water which might be presented by the environment or the contents of the vessel 200 when the manway access panel 215 is removed to service the vessel 200. The manway trough 80 and manway insert channel 82 should be provided within at least one platform section, 20*a* or 20*b*, and is not required to be an all sections, since there is only one manway 210 provided per liquid storage vessel 200.

To complete the assembly of the earthquake dampening platform 10, a flat upper connecting plate 90 of the same thickness as the upper surface plate 70 is attached between the two sections 20*a*, 20*b*, over both common inner attachment plates 50 with a plurality of bolts 92 or other attaching means securing the flat upper connecting plate 90 to both respective hollow segmented inner frame assemblies 30, the flat upper connecting plate 90 extending between each inner peripheral edge 77 of each respective upper surface plate 70. To eliminate intrusion of moisture below the upper surface plates 90, although not shown, it is contemplated that a weatherproofing seal be included within the flat upper connecting plate 90.

Each anchor cleat assembly 100 secures the vessel 200 to the upper surface plates of the assembled platform 10 radial points of symmetry around the lower perimeter portion 205 of the vessel 200, as shown in FIGS. 1-4. Depending upon the location of the manway of the vessel and the positioning of the manway trough of the platform, each anchor cleat assembly 100 is located diametrically across from another along the upper surface plates 70 conforming to the size and shape of the lower perimeter portion 205.

Figure 4:
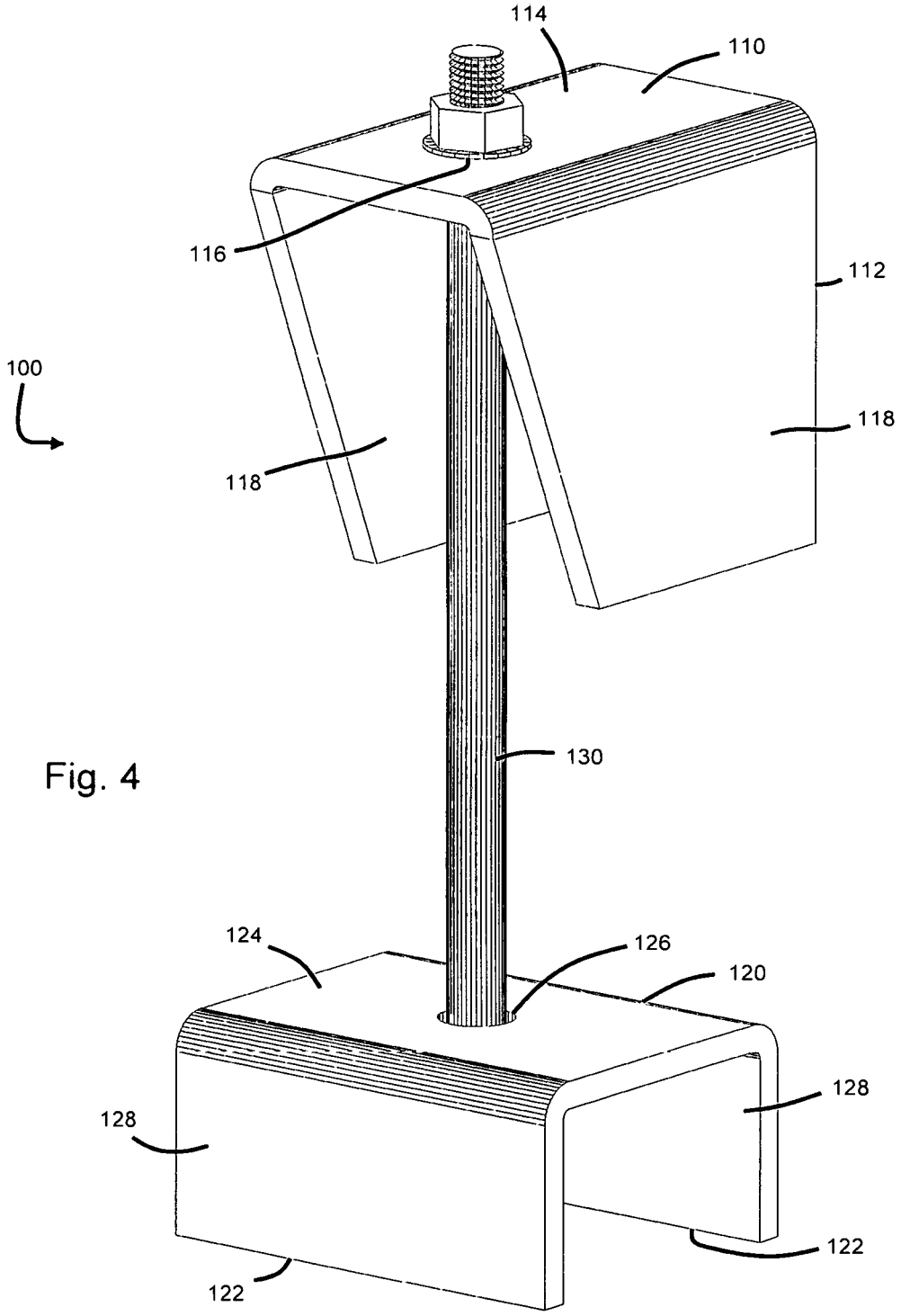
FIG. 4 is an isolation view of the anchor cleat assembly including the tank cleat attaching to the floor cleat by an all thread bolt and an upper torque nut used as the securing means attaching the liquid tank to the earthquake dampening platform.

Each anchor cleat assembly 100, FIG. 4, comprises a tank cleat 110, a floor cleat 120 and a threaded securing means 130. Each tank cleat 110 further defines a vertical tank surface 112 which is attached to the vessel 200 along the lower perimeter margin 205 by welding or other permanent adhesion, an upper plate 114 having a central anchor bore 116 and supporting side plates 118, the side plate 118 extending the upper plate 114 away from the vessel 200. Each floor cleat 120 further defines a horizontal floor surface 122 attached to the upper surface 72 of the upper surface plate 70 in close proximity to the mounted vessel lower perimeter margin 205 by welding, an upper plate 124, a central anchor bore 126 aligned directly below the central anchor bore 116 of each respective tank cleat 110 and supporting side plates 128, the side plates 128 elevating the upper plate 124 from the upper surface plate 70. The threaded securing means 130, which may be an all-thread with an upper and lower nut, or an expanded head bolt with a threaded end, attaches the tank cleat upper plate 114 through its central anchor bore 116 to the floor cleat upper plate 124 through its central bore 126. It is critical and a third essential aspect of the earthquake dampening platform 10 that the torque on the plurality of anchor cleat assemblies 100 be identical, so that equal tension is had in every radial pint of symmetry surrounding the vessel 200 and secured upon the upper surface plates 70 to equally distribute vibration forces between the platform 10 and the vessel 200. In this regard, when the vessel 200 is being established and secured upon the earthquake dampening platform 10, a pattern of radial attachment and tensioning of each cleat assembly 100 be done so in a pattern established by skilled engineering calculation and effort, so that one cleat assembly is not over-tightened while another is left less tight. This radial tensioning is similar to that used in installing an engine head or tightening the head on a snare drum—sequential, radial and intentional and done over a series of tightening phases.

In field use, the platform 10 is assembled and placed upon a flat level surface with the liquid storage vessel 200 properly secured by uniform tension of the platform cleat assemblies 100, providing the vibration dampening platform 10 as a deterrent and damage prevention means to the vibrations presented by an earthquake by absorbing the shock vibrations and deflecting and dispersing them prior to reaching the secured liquid storage vessel 200.

A first portion of the earthquake vibrations is deflected between the lower surface plate 60 secured to the inner frame assembly 30 being limited to the lower plate's 60 outer peripheral margin 66 allowing the remainder of the lower plate 60 to float freely below the inner frame assembly 30. A second portion of the earthquake vibrations are absorbed within the matrix of the hollow tubular frame members comprising the inner frame assembly 30 and sectional voids 35, which provide numerous air pockets which absorb the vibration energy without complete transfer of the energy. A third portion of the earthquake vibration is deferred between the upper plate 70 attached only along its outer peripheral margin 76 to the inner frame assembly secured in the same manner as the vibration absorbed between the lower surface plate 60 and the inner frame assembly 30 discussed above.

It is further contemplated that further earthquake vibration absorption may include dampening coatings applied to the upper surface 72 of the upper surface plate 70 and rubber bearings and bushings incorporated within the anchor cleat assembly 100 components, not shown. Another critical vibration dampening and vibration reduction quality of the earthquake dampening platform is performed by the equally torqued securing means 130 within the anchor cleat assemblies 100 providing the vessel 200 with an equal distribution of any further vibrations not absorbed by the platform 10. It is also contemplated that the platform 10 is coated to reduce corrosion and damage caused by exposure to the liquids and the environment with which the platform and liquid storage tanks may impose.

This earthquake dampening platform 10 may be used with any liquid storage vessel 200 containing petroleum liquids, chemical corrosives, combustibles, liquid oxidizers, strong and weak acids and bases, and any other liquid which may constitute a biohazard/hazardous liquid material or otherwise compromise the environment within which it is stored. The liquid storage vessels 200 can be made of metal or other composite and the tank cleats 110 may be molded within the liquid storage vessel 200, attached by adhesive, welded or attached by additional brackets as long as there is a direct and secured means of ensuring each tank cleat 110 is firmly secured to the liquid storage vessel 200 and withstand the torque applied by the securing means 130 and any vibrations experienced within the platform 10 and liquid storage vessel 200 during an earthquake.

While the earthquake dampening platform 10 has been particularly shown and described with reference to a preferred embodiment thereof, it will be understood by those skilled in the art that changes in form and detail may be made therein without departing from the spirit and scope of the invention.

What claimed is:

1. An earthquake dampening platform upon which a liquid vessel is secured, the platform comprising:

two symmetrical sections;

each said section defining an independent inner frame assembly defining an upper surface, a lower surface, an outer tubular frame member, a first end tubular frame member, a second end tubular frame member, a central tubular frame member secured midway between said first and second end tubular frame members and parallel to said outer tubular frame member, a plurality of parallel inner spanning tubular frame members secured between said outer tubular frame member and said central tubular frame member, with parallel inner extending tubular frame members extending from said central tubular frame member, parallel to said first and second end tubular frame members, each said inner extending tubular frame member and each said first and second end tubular frame members terminating respectively into an exposed plate connecting end in a planar alignment defining a plurality of sectional voids formed within said inner frame assembly in a checkerboard pattern;

a common inner attachment plate welded to each aligned exposed plate connecting end of each said inner extending tubular frame member and each said first and second end tubular frame members, said common inner attachment plate defining a plurality of connector bores, each said connector bore accepting a threaded bolt to attach facing common inner attachment plates from one symmetrical section to another reversed symmetrical section, each said threaded bolt each threaded bolt securing said symmetrical sections, together to form a common earthquake dampening platform for said vessel;

an upper surface plate defining an outer peripheral margin respectively attaching to said upper surface of said inner frame assembly;

a lower surface plate defining an outer peripheral margin respectively attaching to said lower surface of said inner frame assembly; and a plurality of anchor cleat assemblies securely attaching a lower perimeter portion of said vessel to said upper plate, wherein said platform is seated upon a flat level surface with said liquid storage vessel properly secured by uniform tension of each said anchor cleat assembly providing said vibration dampening platform as a deterrent to earthquake producing shock vibrations, absorbing, deflecting and dispersing said shock vibrations prior to reaching said secured liquid storage vessel.

2. The earthquake dampening platform of claim 1, further comprising:

a manway trough and a manway channel with a drainage system positioned below a manway and manway access panel of said vessel, said manway access panel positioned above said manway trough to accommodate the removal of said manway access panel incorporated into said vessel, said manway and said manway access panel located within said vessels secured upon said earthquake dampening platform as required by OSHA regulations, to access an interior of the said vessel for cleaning and safety purposes.

3. The earthquake dampening platform of claim 1, each anchor cleat assembly securing said vessel the said upper surface plate at a radial point of symmetry around said lower perimeter portion of said vessel, each said anchor cleat assembly further defining:

a tank cleat defining a vertical tank surface which is attached to said vessel along said lower perimeter margin by welding or other permanent adhesion, said tank cleat further defining an upper plate providing a central anchor bore and supporting side plates extending said upper plate away from said vessel;

a floor cleat further defining a horizontal floor surface attached to an upper surface of said upper surface plate in close proximity to said lower perimeter margin of said vessel by welding or other permanent adhesion, said floor cleat further defining an upper plate, a central anchor bore aligned directly below said central anchor bore of each respective said tank cleat and supporting side plates elevating each said upper plate from said upper surface plate of said floor cleat; and a threaded securing means attaching each said tank cleat upper plate said central anchor bore to said upper plate of said floor cleat through said central bore, wherein the torque on each said plurality of anchor cleat assemblies is identical, so that equal tension is had in each said radial point of symmetry surrounding said vessel to further equal distribution of vibration forces between said platform and said vessel with a pattern of radial attachment and tensioning of each of said plurality of anchor cleat assemblies being installed and tensioned in a pattern established by skilled engineering calculation and effort, so that one said anchor cleat assembly is not over-tightened while another is less tight.

4. The earthquake dampening platform of claim 1, further comprising:

each said lower surface plate is rectangular and defines an upper surface, a lower surface and an outer peripheral margin, with each respective said upper surface of each said lower surface plate welded or otherwise attached to said lower surface of said inner frame assembly only on each of said four peripheral margins along each said outer tubular frame member, each said first and second end tubular frame members and a lower margin of each said common inner attachment plate with no gaps in welding or adhesion to eliminate intrusion of water between said lower surface plate and said lower surface of said inner frame assembly, wherein one aspect of vibration dampening effect occurs between said lower surface plate and said inner frame assembly; and each said upper surface plate is also rectangular and defines an upper surface, a lower surface, an outer peripheral margin and an inner peripheral edge with each said lower surface of said upper surface plate respectively welded or otherwise attached to each respective upper surface of said inner frame assembly on three peripheral margins along said outer tubular frame member and said first and second end tubular frame members, said the inner peripheral edge extending short of each respective said common inner attachment plate, providing a space between said inner peripheral edge of said upper surface plate and said respective common inner attachment plate providing access for insertion and tightening of said threaded bolts through each of said plurality of connector bores of said respective common inner attachment plates of said two symmetrical sections of said earthquake dampering platform while attaching said facing symmetrical sections forming said united earthquake dampening platform upon which said vessel is secured, wherein said inner peripheral edge is welded to portions of said inner extending tubular frame members extending from said central tubular frame member, along each first and second end tubular frame members and along said outer tubular frame member only, wherein a second essential vibration dampening effect occurs between said lower surface plate and said inner frame assembly.

5. The earthquake dampening platform of claim 1, further comprising:

a flat upper connecting plate of the same thickness as said upper surface plate attached between said two symmetrical sections forming said earthquake dampening platform, over both said common inner attachment plates with a plurality of bolts or other attaching means securing said flat upper connecting plate to each respective segmented inner frame assemblies, said flat upper connecting plate extending between each said inner peripheral edge of each respective said upper surface plate.

* * * * *